United States Patent [19]

Nabulon et al.

[11] Patent Number: 4,936,000

[45] Date of Patent: Jun. 26, 1990

[54] LACING UP OF THREAD TREATING NOZZLES

[75] Inventors: Werner Nabulon, Rüdlingen; Armin Wirz, Ossingen, both of Switzerland

[73] Assignee: Rieter Machine Works, Ltd., Winterthur, Switzerland

[21] Appl. No.: 327,384

[22] Filed: Mar. 21, 1989

Related U.S. Application Data

[63] Continuation of Ser. No. 116,391, Nov. 3, 1987, abandoned, which is a continuation of Ser. No. 81,051, Oct. 2, 1979, abandoned.

[51] Int. Cl.[5] ..... D02G 1/16; D02G 1/12

[52] U.S. Cl. ..... 28/272; 28/255

[58] Field of Search ..... 28/256, 257, 271, 272

[56] References Cited

U.S. PATENT DOCUMENTS

| | | | |
|---|---|---|---|
| 3,237,269 | 3/1966 | Hawkins | 28/272 |
| 3,261,071 | 7/1966 | Clendening, Jr. et al. | 28/271 X |
| 3,698,612 | 10/1972 | Brock | 28/272 X |
| 3,982,412 | 9/1976 | Isoard et al. | 28/271 X |
| 4,040,154 | 8/1977 | Riley | 28/257 |

FOREIGN PATENT DOCUMENTS

| | | |
|---|---|---|
| 2049740 | 4/1971 | Fed. Rep. of Germany . |
| 2817487 | 10/1979 | Fed. Rep. of Germany . |
| 0872234 | 7/1961 | United Kingdom . |

*Primary Examiner*—Werner H. Schroeder
*Assistant Examiner*—Bradley Kurtz DeSandro
*Attorney, Agent, or Firm*—Kenyon & Kenyon

[57] ABSTRACT

A texturizing jet for synthetic filaments is openable and closable to facilitate lacing up. A lacing up system is operable in conjunction with the opening and closing mechanism so that the lace-up operation is semi-automatic. At least one of the parts of the jet has a flexible mounting to ensure face to face sealing contact of the parts when the jet is closed.

35 Claims, 3 Drawing Sheets

Fig. 6
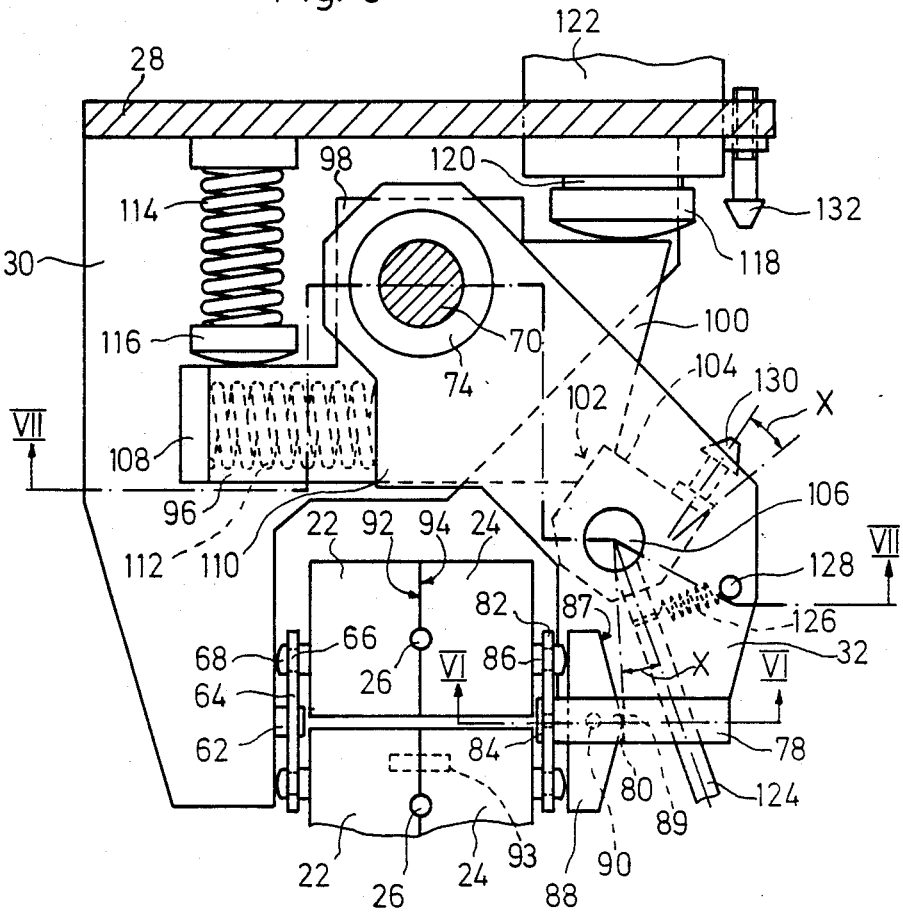
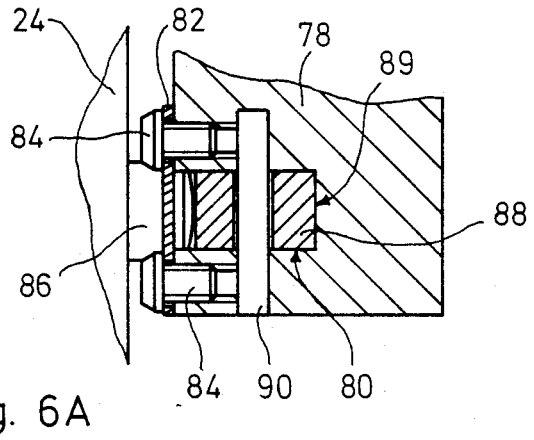
Fig. 6A

LACING UP OF THREAD TREATING NOZZLES

This is a continuation of application Ser. No. 07/116,391 filed Nov. 3, 1987, now abandoned, which is a continuation of application Ser. No. 06/081,051 filed Oct. 2, 1979 now abandoned.

The present invention relates to a thread treating apparatus comprising a treating nozzle through which the thread moves along a substantially predetermined path. The thread is usually subjected to a treating fluid, generally a gas or vapor, while passing through the nozzle. The invention is intended particularly, but not exclusively, for use in thread texturizing apparatus, but it may also have application where the treating nozzle is used to produce entanglements in the thread passing through it. The term "thread" when used herein refers to any continuous textile element, particularly but not exclusively synthetic filamentary material, whether mono-filamentary or multi-filamentary.

PRIOR ART

Thread texturizing by means of a texturizing nozzle (or "jet") is well known—see for example U.S. Pat. Nos. 3,714,686 and 4,100,659 as examples only. These processes may operate on thread drawn from a bobbin, or upon thread received directly from a spinneret producing synthetic filament. In the latter case, there is a well known problem concerned with lacing of the continuously moving thread into the texturizing nozzle.

In one approach to this problem, the continuously moving thread is drawn past the end of a tubular nozzle, the thread is severed in the region of the nozzle entrance, and the free end so formed is blown or sucked into the nozzle—see for example U.S. Pat. No. 4,051,581 and German OLS No. 2,817,487. While these techniques can be made to work satisfactorily, they demand a degree of skill on the part of the machine operator and they also necessitate the insertion of special lace up devices in a relatively small free space available around the texturizing nozzle.

An alternative approach, using an openable and closable nozzle, has already been suggested in UK Pat. No. 872 234, U.S. Pat. Nos. 2,938,257, 3,167,847 and 3,261,071 and German ALS No. 2,049,740. However, none of them deals fully with the lacing up process including both the problems of ensuring accurate laying of the thread in a small diameter passage through the texturizing nozzle and also the problems of laying the thread on the ancillary equipment which is associated with the nozzle, e.g. heating rollers upstream of the nozzle and cooling equipment downstream thereof. Further, very little attention is paid to the achievement of an adequate seal at the nozzle interface, especially when a plurality of threads are treated in the same nozzle assembly.

PRESENT INVENTION

It is an object of the present invention to enable provision of a thread treating apparatus comprising an openable and closable nozzle which is easily laceable without a high degree of manual skill on the part of the operator and which also provides an effective seal at the interface between the nozzle parts without demanding unduly onerous manufacturing tolerances or special seal designs.

The invention uses an openable and closable thread treating nozzle; that is, a nozzle comprising a plurality of parts which define between them a thread treating passage and which are movable relative to each other to open and close the passage to enable insertion of a thread. Unless otherwise indicated by the context, the term "nozzle" when used hereinafter refers to an openable and closable nozzle as defined above. Such a nozzle preferably comprises only two parts movable relative to each other.

The invention provides a thread treating apparatus comprising a treating nozzle for treating a thread moving along a substantially predetermined thread path and means for moving the nozzle between a retracted, non-operative position clear of the thread path and an extended operative position in which the nozzle encloses the thread path.

The thread to be texturized can taken into the nozzle by movement of the latter from the retracted to the extended position, while the thread itself is held in a substantially fixed disposition in or about the thread path. Suitable thread guide means can be provided to hold the thread while the thread is taken in by the nozzle. In addition, the movement of the nozzle to the retracted position can provide additional space in the neighborhood of ancillary equipment, such as heating rollers upstream of the nozzle, to facilitate lacing up of the ancillary equipment.

The moving means may comprise a carrier member upon which the parts of the nozzle are mounted and which is itself movable between extended and retracted positions to cause corresponding movement of the nozzle carried thereby. The carrier may be reciprocable between these positions and is preferably slidable along a suitable guide track. Movement of the carrier may be caused by a pressure fluid operated means, e.g. a pneumatically operated piston and cylinder unit.

Thread guide means may be provided at least downstream of the nozzle considered relative to the thread path passing through the treating passage of the nozzle. This guide means is movable between an inoperative position in which the guide means engages a will not contact a thread moving along the thread path in use, and an operative position in which the guide means engages thread moving along the thread path and locates the thread to lay the thread in the nozzle passage during closing of the nozzle. Preferably, a similar thread guide means is provided upstream of the nozzle.

Each or either of the thread guide means may comprise a thread guide element mounted for pivotal movement between the two positions. The or each element may comprise a substantially V-shaped notch such that the thread lies at the tip of the notch when the element is in the operative position. The thread guide means may be such that the thread is laid upon one of the nozzle parts before the nozzle is fully closed.

The invention further provides a thread treating nozzle in which at least one of the parts has a flexible mounting to ensure firm sealing contact of sealing surfaces around the thread passage through the nozzle when the latter is closed.

There may be two nozzle parts mounted on a common carrier, one part being fixed to the carrier and the other part being movable thereon to open and close the nozzle. Preferably the opening and closing movement comprises a pivotal movement of the moveable part around a pivot axis fixed on the carrier. The parts may be normally biased open and operating means may be provided to close the nozzle against the normal opening bias. For example, the bias may be provided by a compression spring and the operating means may comprise a pressure fluid operated unit, preferably a pneumatic piston and cylinder unit.

BRIEF DESCRIPTION OF THE DRAWINGS

By way of example some embodiments of the invention will now be described with reference to the accompanying diagrammatic drawings, in which FIG. 6 is a more detailed plan view (partially cut away) of a thread treating nozzle in accordance with the invention, together with a carrier therefor, FIG. 6A is a side elevation in section of a detail of FIG. 6 viewed on the line VI—VI in FIG. 6.

DETAILED DESCRIPTION OF THE INVENTION

Figure 1:
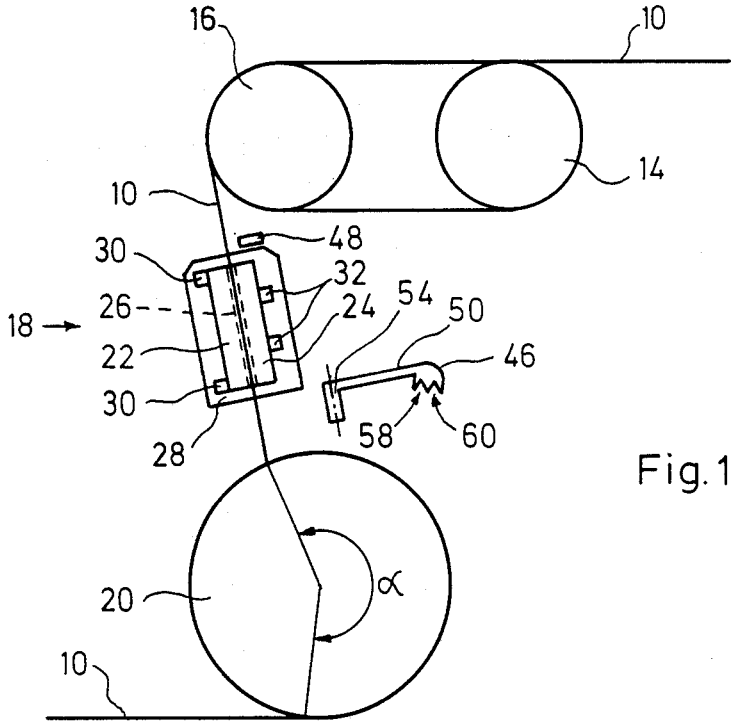
FIG. 1 is a front view of a texturizing station in a texturizing apparatus according to the invention.

FIGS. 1 to 3 and 5 illustrate a texturizing "station" in which two threads 10, 12 respectively (FIG. 5) are texturized simultaneously. Each thread comprises a plurality of synthetic mono-filaments which are passed directly to the texturizing station from a spinneret (not shown). Since the process, and the apparatus, is the same for each of the threads 10 and 12, the following description will refer only to the thread 10 but will be understood to apply equally to thread 12.

The station comprises pre-heating rolls 14, 16 around which the thread is passed a predetermined number of times to produce a desired temperature as the thread leaves the downstream roll 16. The thread is then passed to a texturizing nozzle 18 which is located as close as possible to the roller 16. From the nozzle 18, the thread passes to a cooling drum 20. After passing around a predetermined portion of circumference of the drum, as indicated by the angle $\alpha$ in FIG. 1, the thread passes to a suitable wind-up (not shown).

In order to facilitate lacing up, the nozzle 18 is formed in two parts 22, 24, in a manner known per se. The parts define between them a thread passage 26 extending through the nozzle and openable and closable by relative movement of the nozzle parts. Since the exact form of the treatment passage 26 is not a feature of the present invention, it is illustrated in the drawings as a simple straight-through passage. It will be understood however that the exact form of this passage may be adapted to suit the texturizing process which is to be used in the nozzle. At least one part is also provided with an infeed port (not shown) for treatment fluid required in the process.

Figure 2:
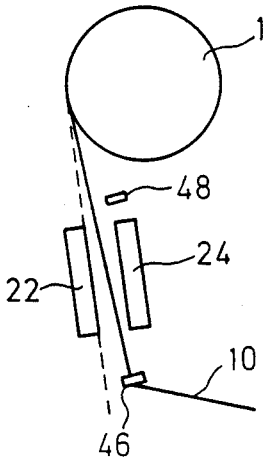
FIGS. 2 and 3 show some of the parts shown in FIG. 1 in different dispositions.

Nozzle parts 22, 24 are carried on a carrier head or member in the form of a plate 28. Nozzle part 22 is rigidly fixed to the plate 28 by carrier arms 30 extending forwardly from the plate. Nozzle part 24 is also mounted on carrier arms 32, but these arms are movably mounted on the plate 28 to move nozzle part 24 between the closed position in which the part 24 engages nozzle part 22 (FIG. 1) and an open position in which the part 24 is spaced from nozzle part 22 to leave a gap for taking in of a filament into the passage 26 (FIG. 2). A suitable device for moving nozzle part 24 will be described below with reference to FIGS. 6 and 7.

Figure 5:
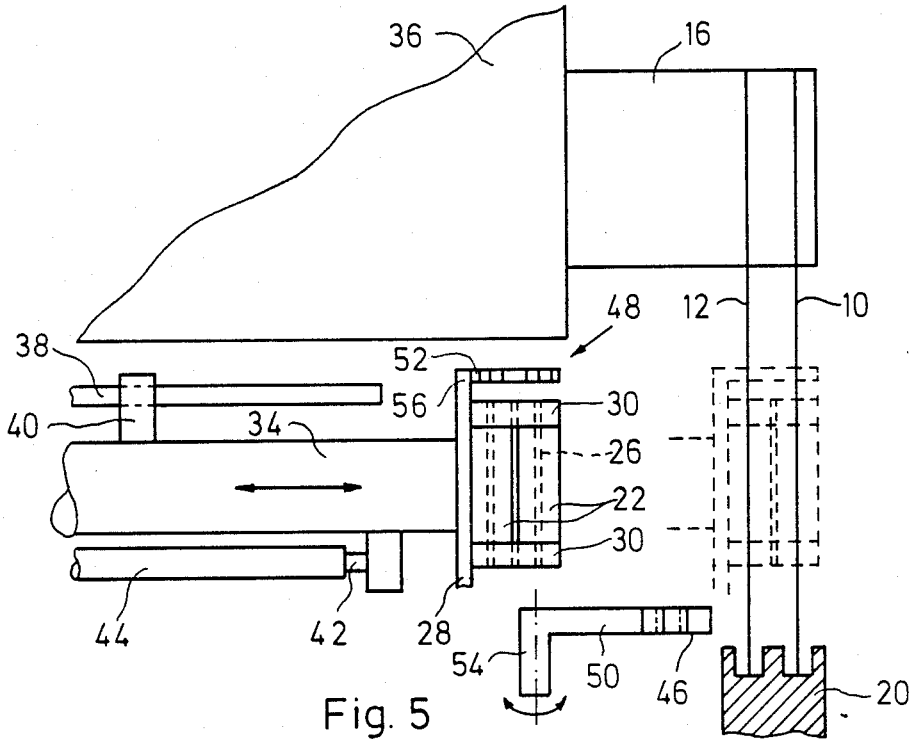
FIG. 5 is a side elevation of the system shown in FIGS. 1 to 3 and showing the important parts in two different operating dispositions.

Plate 28 is secured to a carrier bar 34 (FIG. 5) extending rearwardly from the plate into the machine frame, part of which is indicated at 36 in FIG. 5. Bar 34 is suspended from a guide track in the form of a rod 38 fixedly mounted in the machine frame by means not shown. The suspension is by way of slider element 40 which can slide on rod 38 with low friction. Also secured to the bar 34 is a connector rod 42 connecting the bar with the piston (not shown) of a pneumatically operated, double acting piston and cylinder unit. The cylinder of this unit is shown at 44 and is fixedly mounted in the machine frame by means not shown. Reciprocation of the piston as indicated by the double headed arrow in FIG. 5 carries the plate 28, and the nozzle pair carried thereby, between the retracted position shown in full lines in FIG. 5 and the extended position shown in dotted lines in the same Figure.

It will be seen immediately from FIG. 5 that when the nozzles 18 are in their retracted positions, they leave the thread paths between the roller 16 and the cooling drum 20 completely free. In fact, as shown in FIG. 5, the nozzle and carrier structure can withdraw so far into the machine frame that the full operating length of the roller 16 is left unobstructed. This is very advantageous in facilitating repeated wrapping of the threads around the rollers 14 and 16 during lacing up of the apparatus, while enabling the nozzles, when in the extended position, to lie very close to the downstream heating roller 16. This in turn facilitates control of the temperature of each thread as the thread enters the texturizing nozzle.

In order to enable semi-automatic lacing up of the nozzles, a controllably movable thread guide element 46 is provided to engage the threads downstream of the nozzles parts considered along the thread paths. Element 46 is plate-like, with a W-shaped edge providing two V-shaped notches 58, 60 (see FIG. 1). The element is mounted on a lever 50 which is carried by a pivot mounting 54 in the body of the machine. As seen in FIGS. 1 and 5, element 46 is in an inoperative position in which lever 50 projects forwardly and to the right from mounting 54 at on angle of about 45° to the plane of FIG. 1. As best seen in FIG. 5, element 46 is held clear of the drum 20 so that an operator can easily lay threads in the open notches 58, 60. The pivot axis of mounting 54 is substantially parallel to the thread paths between roller 16 and drum 20, and lever 50 is pivotable on this mounting to swing element 46 through a position in which the apices of the V-notches intersect, or at least pass very close, to respective thread paths. The pivot axis of mounting 54 is preferably aligned with the thread paths as viewed from the front of the machine, but in order to avoid cluttering the drawing, it has been shown slightly offset in FIG. 1. The principle is the same for both positions of the pivot axis.

In addition to the guide element 46, which engages the threads downstream of the nozzles 18, the guide system comprises an upstream guide element 48, having a W-shaped-guide edge similar to that on element 46. Element 48 is mounted on plate 28 for movement therewith, being carried by a lever 52 (FIG. 5). Lever 52 is mounted on plate 28 by pivot mounting 56 so that, when plate 28 is in its forward position, element 48 can be swung through a position in which the apices of its notches intersect or pass very close to the desired thread paths. Pneumatically operated piston and cylinder units (not shown) are provided to rotate levers 50, 52 around their respective pivot mountings in accordance with a predetermined control sequence which will appear from the following description. The arrangement is such that element 48 also has a fully withdrawn position, shown in FIG. 1, in which the element 48 cannot contact a thread passing along the normal texturing thread path between roller 16 and drum 20. Thus, after lacing up is complete, the upstream guide element 48 does not contact the thread while the latter is in a preheated state immediately prior to entering the nozzle 18; the thread is extremely sensitive in this state and contact with the guide element 48 during normal texturing operation would result in uncontrollable variations in the textured thread quality. Similarly, the downstream element 46 cannot contact the fully textured thread leaving the nozzle 18; such contact would interfere severely with the texturing operation, and would greatly jeopardize if not nullify the operation.

A lacing up operation using this system takes place in the following general sequence (thread 10 only will be referred to, but the same applies to thread 12). In the starting condition, plate 28, and element 48 carried thereby, lie in the retracted position and the texturizing nozzle is closed. In this condition the nozzle 18 is heated by any suitable means. Due to this pre-heating, the nozzle 18 will be ready for immediate texturing operation when reaching the extended position. The operator takes up the thread to be textured in a suitable portable suction apparatus (not shown) and wraps the continuously moving thread a predetermined number of times around the rollers 14 and 16. He then lays the thread in guide element 46 (FIG. 1) which is in a retracted position, so that drum 20 does not interfere. The central triangular projection on the guide edge of element 48 seperates the threads automatically. He can then press an initiating button on a control panel (not shown) on the machine so that subsequent stages of the lacing operation are effected automatically.

In the first stage of the automatic lacing operation, guide element 46 is moved to the position shown in FIG. 2 in which the thread is held in the plane of the desired thread path between the roller 16 and the cooling drum 20. The nozzle 18 is now opened and plate 28 is moved to the right as viewed in FIG. 5 so that the thread is taken in between the nozzle parts 22, 24. The nozzle is then closed during which the guides lay the thread in thread passage 26 as further described below. Supply of texturing fluid to the nozzle is started automatically as soon as the nozzle is closed so that texturing begins immediately. Supply of such fluid is cut off automatically whenever the nozzle is open.

Operation of the guides is as follows. When the operator presses the initiating button, lever 50 is first pivoted around mounting 54 to bring the element 46 into the intermediate position shown in FIG. 2 in which the threads (shown in full lines) lie in the plane of the texturizing paths, but not in the paths themselves (indicated in dotted lines). As the nozzles are moved forward to take in the threads, the spacing of the nozzle parts 22, 24 when in the open position being sufficient to ensure that part 24 does not interfere with the lengths of thread extending between roller 16 and element 46, element 48 is simultaneously moved into alignment with the threads, although still in its fully withdrawn position shown in FIG. 2 and therefore without interference with the threads at this stage.

Figure 3:
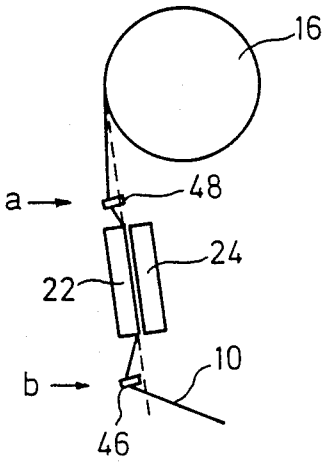

When the nozzles have reached their fully extended position, levers 50 and 52 are pivoted simultaneously to carry the lengths of thread already located within the nozzles into contact with the nozzle parts 22 and in particular to lay the threads within the passage portions 26 defined in those nozzle parts. This condition is shown in FIG. 3 and it will be seen that each thread is deflected slightly beyond its texturing path as indicated at a and b. The threads slide on the walls of the V notches to lie at the apices thereof and are thus accurately located relative to the thread paths It will be noted also, that the spacing between nozzle parts 22 and 24 shown in FIG. 3 is less than that shown in FIG. 2, indicating that each nozzle is being closed simultaneously with this laying on movement of thread guides 46 and 48. As soon as the nozzles are fully closed, elements 46 and 48 are pivoted back to their fully withdrawn positions, so that texturing can proceed without interference from these guide elements The operator now simply lays the threads on the drum 20 and texturizing can proceed normally.

In FIG. 5, the threads 10, 12 have been shown extending along straight line paths from roller 16 to drum 20. This is not necessary as guides 46, 48 will straighten the important length of each thread (through the nozzle) during lacing up. Thus, the threads may diverge from a relatively narrow spacing on roller 16 (determined for example by the dimensions of the aspirator head used in lacing up) to their spacing as they pass through the nozzles determined by the nozzle dimensions.

Figure 4:
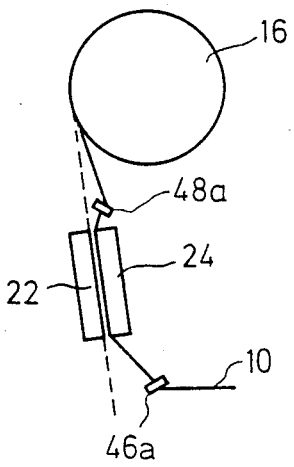
FIG. 4 is a view similar to FIG. 3 but illustrating a modified thread guide arrangement.

It is not necessary that the thread guides should lay the thread upon the fixed nozzle part 22. FIG. 4 illustrates a modification in which the guides lay the threads upon movable nozzle parts 24. Guide element **46*a* is similar to element 46 and is similarly mounted, but is movable only between the fully withdrawn and intermediate positions shown in FIGS. 1 and 2 respectively and does not move to the final position of the element 46 shown in FIG. 3. Element 48*a* is similar to element 48 but is mounted on plate 28 so as to lie on the other side of the thread path as viewed from the front of the machine. Element 48*a* therefore pivots from left to right as viewed in FIG. 4 and carries each thread against a nozzle part 24 as the latter moves towards the closed position. Element 48*a* is then pivoted leftwards as viewed in FIG. 4 to leave the texturizing thread path free and element 46*a* is pivoted rightwards to clear the cooling drum 20** ready for the next lacing operation.

It is however highly desirable to lay the thread on one or the other of the nozzle parts before complete closing of the nozzle, since in this way the nozzle part concerned cooperates in accurately locating the thread prior to full closing of the nozzle, and thus reduces the risk of catching of the thread between the nozzle parts. When left free, the thread will vibrate slightly about a mean position and this vibration is eliminated by contact with one nozzle part prior to full closure of the nozzle.

Figure 7:
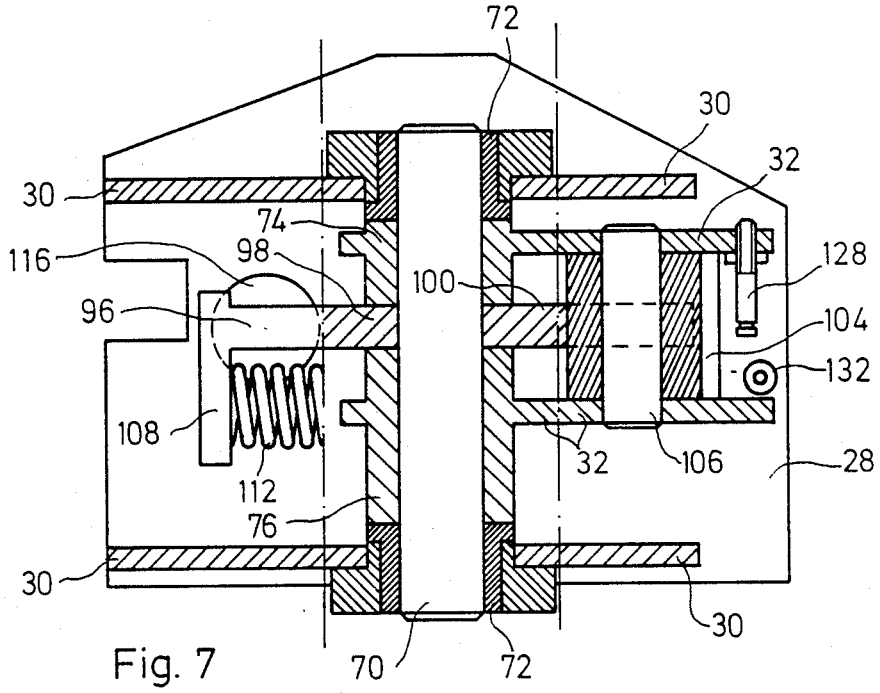
FIG. 7 is a section on the line VII—VII shown in FIG. 6 but with some parts of the mechanism removed.

One example of a carrier and nozzle assembly suitable for use in the apparatus shown in FIGS. 1 to 5 will now be described in further detail with reference to FIGS. 6, **6*a* and 7. Parts corresponding with the earlier Figures bear the same reference numerals It will be seen therefore that FIG. 6 and 7 illustrate a carrier plate 28 and two pairs of carrier arms 30, 32 for nozzle parts 22 22. Arms 30 are rigidly fixed to the plate 28 and each arm 30 (upper and lower) carries a mounting structure for a pair of nozzle parts 22. Each mounting structure comprises a stud 62 (FIG. 6) carrying a plate 64 which projects to either side of the stud 62. Each plate 64** has a pair of upwardly facing openings to receive necks 66 formed on studs secured to the nozzle portions 22. Each nozzle stud has a rounded head 68 engaging the arm 30. Thus, each nozzle part 22 is suspended by its studs between the upper and lower plate 64 while being easily removable for maintenance and replacement. Since the nozzle parts 22 remain in fixed positions on the arms 30 during normal operation, it is convenient to connect inlet and outlet leads (not shown) for treatment fluid and/or nozzle heating fluid to the nozzle parts 22. Each nozzle part 22 can however pivot to a limited extent about the points of contact between the heads 68 on the studs and the arms 30, the necks 66 providing sufficient play to enable this.

Arms 30 also carry between them a spindle 70 located in suitable bearing bushes 72 (FIG. 7). The upper arm 30 and bearing bush 72 have been omitted from FIG. 6 to show the mechanism underneath them. Upper and lower sleeves, 74 and 76 respectively, are rotatably mounted on spindle 70. Sleeve 74 is integral with the upper arm 32 and sleeve 76 is integral with the lower arm 32. As best seen from FIG. 6, each arm 32 is approximately in the form of a dog-leg lever, and the free ends of the arms are joined by connector piece 78 which extends above the upper arm 32 and below the lower arm 32. At the edge facing arms 30, connector 78 is formed with upper and lower recesses, the lower recess 80 being seen in FIG. 6A. Each recess has associated therewith a nozzle mounting system which is the same for each recess, so that only one will be described in detail.

A plate 82, similar to and immediately opposite the plate 64, is secured to the connector 78 by screws 84. The upwardly facing openings in the plate 82 receive necks on studs 86 on the nozzle parts 24. The rounded heads on studs 86 engage an abutment surface on a back-up element 88 which is secured in the recess 80 by a retaining pin 90. The surface 87 of element 88 is cut away at an angle from an apex 89 to leave spaces between itself and the end wall of recess 80 as best seen in FIG. 6 so that the element 88 acts as a balancing means in the form of a balance lever.

The material and thickness of each plate 82 is chosen to be flexible under the forces applied to the plate 82 in use. Thus, each plate 82 can flex about its mounting on the connector 78. Also, each back-up element 88 can pivot about the point of contact of the apex 89 with the rear wall of the recess 80, sufficient play being provided around the pin 90 to enable this. Still further, the material, dimensions and spacing of arms 32 are so chosen that the arms can flex independently, enabling the rigid connector 78 to adopt a small angle of inclination relative to the axis of spindle 70.

The illustrated mounting enables the achievement of good sealing contact despite manufacturing tolerances and without highly accurate tool-setting during mounting of the nozzle parts on the arms. Inaccuracies which result in slight misalignment of the whole nozzle assembly (both nozzles together) relative to the axis of spindle 70 will be taken up by differential flexing of arms 32. Inaccuracies which result in misalignments of individual nozzles, e.g. differences in the alignment of the individual nozzles of the pair and/or differences in the alignment of the parts of an individual nozzle, can be taken up by one or more of three possible movements permitted by the mounting system i.e.:

I. pivoting of the nozzle parts 22, 24 about the zones of contact of their support studs with the arms 30 or back up elements 88, the necks of the studs having sufficient play in the support plates 64, 82 to permit rolling of the rounded heads of the studs on their support surfaces. If desired, rounding of the heads of the studs on parts 22 can be omitted, all adjustment occuring by movement of parts 24. This movement takes account of engagement of the parts on an individual nozzle on one side before engagement of the same parts on their opposite sides.

II. pivoting of elements 88 about their apexes 89, and flexing of plates 82. This movement occurs if the top (or bottom) of one nozzle engages before the top (or bottom) of the other, i.e. the sealing surfaces of the two nozzles are not co-planar even after movement I (this may occur whether the sealing planes are parallel or relatively inclined).

III flexing of arms 32. If, say, one nozzle has closed completely and the bottom of the other has engaged before the top (i.e. the sealing planes of the nozzles are not parallel even after movement II), then the upper arm 32 must continue moving in the closing direction to force the top of the second nozzle to close, this arm movement being accompanied by pivoting of upper element 88.

It will be seen, therefore, that back up elements 88 act as balancing means, in the form of balance levers, ensuring that the closing force applied via the arms 32 is effective equally on both nozzles. Thus, reasonably accurate formation of plane sealing faces 92, 94 (FIG. 6) suffices for achievement of an adequate seal. It is to be noted, however, that for each element 88, the abutment of apex 89 with connector 78 provides the balancing pivot and not the pin 90; the latter is wholly inadequate to withstand the forces involved in closing the nozzles, which forces must be applied via the balance pivots. Also, the abutment of the elements 88 with the rounded heads on the studs 86 provides the force-transmitting connection between the balance levers and the nozzle parts 24. The plates 82 are simply provided as elements of a suspension mounting for the nozzle parts and they do not transmit nozzle-closing forces; they must, however, be capable of flexing in response to such forces when innacuracies in nozzle alignment make this necessary.

Movement of the arms 32 to open and close the nozzles is effected by way of the three-part, complex lever 96, 98, 100. The central portion 98 of this lever is rotatably mounted on the spindle 70 between sleeves 74 and 76. The rightwardly extending wing 100 (FIG. 6) has an angular cut out 102 to receive a correspondingly formed edge on a sleeve 104 which is secured between the upper and lower arms 32 by a spindle 106. Sleeve 104 is rotatable about the spindle 106 for a purpose which will be described further below. For the present, however, it is to be assumed that sleeve 104 is held in the position illustrated in FIG. 6 so that clockwise rotation of the complex lever about spindle 70 will cause corresponding rotation of the arms 32 by way of the sleeve 104.

The leftwardly extending wing 96 (as viewed in FIG. 6) of the complex lever carries at a free end a downwardly projecting plate 108. At least the lower arm 32 has a triangular projection 110 (FIG. 6) providing a surface opposed to the plate 108. A suitable compression spring connection 112 is placed between plate 108 and projection 110 on the lower arm 32. Thus, when the complex lever turns anti-clockwise around spindle 70, arms 32 must follow because of the compression spring connection 112.

The complex lever is biased anticlockwise as viewed in FIG. 6 by a compression spring 114 acting between plate 28 and a head 116 which engages the wing 96 of the lever. Thus, in the absence of a closing force on wing 100 sufficient to overcome the bias of spring 114, the nozzles will be biased open. The necessary closing force is applied to wing 100 via a head 118 formed on a connecting rod 120 fixed to the piston of a piston and cylinder unit, the cylinder of which is shown at 122. Cylinder 122 is secured in the plate 28. The piston and cylinder unit is pneumatically operated and is single acting in a sense tending to turn the complex lever in a clockwise direction and with a force sufficient to overcome the compression spring 114 and to produce an adequate sealing pressure between the surfaces 92, 94 in the nozzles. A pressure sensitive switch, responsive to pressurisation of cylinder 122 is used to control supply of texturising fluid to the nozzles so that supply is cut off as soon as the nozzles open.

In its preferred form the cylinder 122 is controlled automatically to have two closing stages. In the first stage, the cylinder exerts a relatively small closing force, sufficient to overcome spring 114, and the piston moves relatively quickly to bring the nozzle parts from the full open position into initial engagement. The cylinder then exerts a relatively large closing force, sufficient to ensure an adequate seal, and the nozzle parts move relatively slowly to their fully closed, passage sealing positions.

The normal degree of opening required of the nozzles is not very large. In the pivoting system illustrated, as opening angle less than 15° is satisfactory, and an opening angle of 5-10° is normally adequate for lacing up with the illustrated guide system. However, a greater degree of opening will be required for maintenance of the nozzles and for replacement of nozzle portions. This greater degree of opening is enabled by the spring connection 112 and the rotatability of sleeve connector 104. The latter has connected thereto an operating lever 124 which projects radially outwardly from spindle 106 through a suitable opening (not shown) provided in connector 78. Lever 124 is biased anticlockwise as viewed in FIG. 6 by a tension spring 126 extending between itself and a pin 128 secured in the upper arm 32. Thus, sleeve 104 is biased into a normal position shown in FIG. 6 in which the sleeve 104 maintains a force transmitting connection between the complex lever and the arms 32. However, lever 124 can be manually pivoted in a clockwise direction as viewed in FIG. 6, against the bias of spring 126 through the angle X. This breaks the force transmitting connection between the complex lever and the arms 32, and leaves the latter free to rotate through a substantially greater angle in a nozzle—opening direction. This relatively free pivoting of the arms 32 about spindle 70 can continue until a catch element 130 on sleeve 104 engages a corresponding catch element 132 on plate 28. The nozzles are then held open until the catch is manually released by operation of the lever 124 to enable return of the arms 32 to the operational position shown in FIG. 6.

The arrangement may be such that this greater degree of opening of the nozzles is impossible while the nozzles are in the normal texturing position because of the closeness of the nozzles to the roller 16. The system moving carrier 28 (i.e. bar 34, guides 38, 40 and cylinder 44) may be adapted to move the carrier still further forward than the dotted line position shown in FIG. 5, to a maintenance position in which the above described maintenance operations can be carried out. This additional movement may occur in response to operation of a suitable button on the machine control panel.

It will be understood that the operating mechanism illustrated in FIGS. 6 and 7 is shown by way of example only and that alternative mechanisms may be designed to enable the sequence described with reference to FIGS. 1 to 5. For example, we have referred to flexibility in the mountings of the nozzle parts to enable establishment of face-to-face sealing contact of those parts. In the illustrated embodiment, this flexibility arises from two sources—(a) the inherent flexibility of the arms 32, and (b) play in the force-transmitting connections between the nozzle parts and the force applying means (cylinder 122). For the individual nozzle, such play is provided between the support studs 86 and the surfaces which apply closing forces to them. For the nozzle assembly as a whole, additional play is provided at the balance regions of the balance levers 88. Closing forces are therefore transmitted via rolling/pivoting contact surfaces. The closing forces could be transmitted via other means providing the necessary flexibility e.g. via some form of compressible or torsion connection, instead of transmission of forces via contact surfaces. However, the illustrated, purely mechanical, arrangement is far simpler and less likely to give rise to maintenance problems. To ensure that the parts are brought together accurately despite the play provided in their mountings, they may have interengaging guide elements. For example, one part may have guide pins such as those shown at 93 (dotted lines) in FIG. 6 and the other may have openings to receive such pins.

The invention is not limited to a nozzle assembly comprising a pair of individual treating nozzles on the same carrier—there could be only one such nozzle per carrier (station) or more than two. Where a plurality of nozzles is provided in one assembly, the nozzles could have individual closing means, and there would then be no need for a balancing device to balance the effect of a single closing means on the nozzles of the plurality. However, such an arrangement would demand a considerable amount of space and would also need a sophisticated control system to enable desired relative operation of the nozzles in the assembly. Also, more than one treating passage could be provided through a single openable and closable nozzle block, but this will complicate the problems of ensuring adequate sealing of the block, particularly between the passages through the block.

The bias spring 114 could be omitted if the closing means (cylinder 122) is made double acting, or could be replaced by a controllable opening means such as an additional fluid pressure operated device. The degree of opening of the nozzle could be made such that it is unnecessary to provide for additional opening of the nozzle for maintenance purposes, and this will enable simplification of the force transmitting linkage between the nozzle and the force-producing means (cylinder 122). However, the relatively small opening angle attained in the illustrated system is preferred because this enables relatively rapid closing of the nozzle once the nozzle has reached a forward position, improves the safety of the system by reducing the risk of an attendant catching a hand between the nozzle parts and reduces the risk of damage to the system by reducing the risk of an attendant inserting tools or other elements between the nozzle parts. At the same time, the relatively small normal opening angle reduces the demand for space around the nozzle at least during normal operation. Such space is always at a premium in texturing machines As described, special arrangements, such as additional forward movement of the nozzle assembly, can be made for special circumstances such as maintenance/replacement of nozzle parts.

The movement of the nozzle(s) as a whole between forward and retracted positions is highly advantageous in providing free space around the ancillary equipment (rollers 14, 16) for threading up the latter, while enabling very close spacing of the nozzle(s) and ancillary equipment in normal operation. The same movement is advantageously used to take the thread(s) into the nozzle(s) since the controlled movement of the nozzle parts, with the threads stationary, enables accurate taking in with only a small opening angle of the parts (or relatively small spacing of the parts if their relative movement involves reciprocation rather than pivoting).

Still further advantages are provided by the flexible mounting of at least one part of each nozzle enabling accurate closing and sealing of each nozzle without sealing means additional to the facing surfaces on the nozzle parts. In particular, the illustrated system involving only a single closing force producing element (cylinder 122) and a mechanical linkage to distribute the closing forces in a desired manner (preferably, through not essentially, equally) between a pair of nozzles in an associated nozzle assembly, provides a simple solution to the problem of controlling simultaneously a plurality of nozzles at a given texturing station while taking up the minimum amount of space around the nozzles.

What is claimed is:

1. A thread treating apparatus comprising a treating nozzle for treating a thread moving along a substantially predetermined thread path, said nozzle having a first part including a face and a groove in said face and a second part including a face, at least one of said parts being movable relative to the other part between an open position spaced from each other and a closed position with said faces in contact with each other and with said groove defining a thread treating passage therebetween; and means for moving said nozzle between a retracted non-operative position clear of the thread path and an extended operative position in which said nozzle encloses the thread path.

2. An apparatus is claimed in claim 1 including means for holding a thread stationary in said thread path during movement of said nozzle into said operative position.

3. Apparatus as claimed in claim 1 which further comprises ancillary equipment upstream and downstream of said nozzle, and said retracted position leaves an unobstructed space for lacing of said ancillary equipment upstream of said nozzle.

4. Apparatus as claimed in claim 3 wherein said ancillary equipment upstream of said nozzle is a roll and said retracted position leaves the circumference of said roll free for wrapping of thread therearound.

5. An apparatus as claimed in claim 1 which further comprises a movably mounted carrier member for moving said nozzle between the retracted and extended positions.

6. An apparatus as claimed in claim 5 wherein said carrier member is reciprocable to move said nozzle between said retracted and extended positions.

7. An apparatus as claimed in claim 5 wherein one of said nozzle parts is fixedly mounted on said carrier member and another part is movably mounted on said carrier member to open and close said passage in said nozzle.

8. An apparatus as claimed in claim 7 wherein said movable nozzle part is rotatable about an axis fixed on said carrier member.

9. An apparatus as claimed in claim 6 which further comprises a first means for biasing said nozzle parts into an open position and closing means to close said nozzle in opposition to said first means.

10. Apparatus claimed in claim 1 further comprising thread guide means upstream and downstream of said nozzle considered relative to said thread path, each said guide means being movable between an inoperative position to leave the thread free to move along said path without disturbance and an operative position to engage and locate the thread to lie in said passage during closing of said nozzle.

11. Apparatus as claimed in claim 10 wherein said guide means are arranged to lay the thread upon one of said nozzle parts prior to complete closing of said nozzle.

12. An apparatus as claimed in claim 10 wherein at least one of said guide means comprises an element provided with at least one substantially V-shaped notch to locate a thread at the apex of said notch.

13. An apparatus as claimed in claim 1 including means for holding a thread stationary about said thread path during movement of said nozzle into said operative position.

14. A nozzle assembly comprising a plurality of nozzles, each nozzle having at least one part thereof with a flexible mounting to permit adjustment of said part to make face to face sealing contact with another part of the nozzle, means for applying a closing force to each said nozzle of the plurality to close said parts thereof and balancing means associated with each nozzle of the plurality to ensure that the closing force is effective equally on each.

15. An assembly as claimed in claim 14 comprising two such nozzles and said balancing means includes a balance lever mounted to pivot about a predetermined pivot surface, the closing forces being applied via said surface and the nozzle engaging the balance lever on either side of said surface.

16. An assembly as claimed in claim 15 to wherein said pivot surface is formed by engagement of an apex on the balance lever with an abutment on a support member therefor.

17. An assembly as claimed in claim 14 which further comprises a structure carrying said balancing means and capable of flexing to take up misalignment in the assembly.

18. An assembly as claimed in claim 17 wherein said structure comprises a pair of arms capable of differential flexing.

19. A thread treating nozzle comprising a pair of parts defining a thread treating passage therebetween, at least one part being movable relative to the other part between an open position spaced from said other part and a closed position in contact with said other part; and a flexible mounting on at least one of said parts to permit adjustment of said at least one part to make face-to-face sealing contact with the other part to enclose said thread treating passage, said flexible mounting having relatively moveable abutting surfaces for transmitting nozzle-closing forces therebetween.

20. A nozzle as claimed in claim 19 wherein at least one of said surfaces is a rounded surface to enable a rolling movement on the other said surfaces.

21. A nozzle as claimed in claim 19 wherein said flexible mounting includes a flexible suspension connection.

22. A thread treating apparatus as set forth in claim 1 further comprising at least one preheated roll for heating at least one synthetic thread upstream of said nozzle; and a cooling drum or cooling a heated thread downstream of said nozzle.

23. A texturizing nozzle for synthetic thread comprising a pair of nozzle parts for defining a thread treating passage therebetween; and means for moving one part relative to the other part to open and close said passage for insertion of a thread into said passage, said means being flexible to permit adjustment of said parts into face-to-face sealing contact along said treating passage, said means including at least one arm, a mounting structure on said arm receiving said other nozzle part thereon, said mounting structure including a plate with an opening and having a rounded head engaging said arm to permit said other nozzle part to pivot a limited extent on said head relative to said arm.

24. A texturizing nozzle for synthetic thread comprising a pair of nozzle parts for defining a thread treating passage therebetween; and means for moving one part relative to the other part to open and close said passage for insertion of a thread into said passage, said means being flexible to permit adjustment of said parts into face-to-face sealing contact along said treating passage, said means including a pivotal arm and an element mounted in said arm and receiving said one nozzle part, said element being pivotally mounted in said arm to pivot a limited extent relative thereto.

25. A texturizing nozzle for synthetic thread comprising a pair of nozzle parts for defining a thread treating passage therebetween; and means for moving one part relative to the other part to open and close said passage for insertion of a thread into said passage, said means being flexible to permit adjustment of said parts into face-to-face sealing contact along said treating passage, said means including a pair of pivotally mounted arms mounting said one nozzle part thereon, said arms being spaced relative to each other to flex independently of each other.

26. A nozzle assembly for texturing threads comprising at least two nozzles, each said nozzle having a pair of nozzle parts for defining a thread treating passage therebetween;

means for moving one part of each said nozzle relative to the other part of each said nozzle to open and close each said passage simultaneously; and balancing means disposed in said moving means for imposing an equal closing force on each nozzle upon closing of said parts of each nozzle into face-to-face sealing contact.

27. A nozzle assembly as set forth in claim 26 wherein said balancing means includes a pivotally mounted balance lever abutting said nozzles at respective ends of said lever.

28. A nozzle assembly as set forth in claim 27 wherein said lever has an apex abutting a wall of a recess in a connector supporting said lever within said means for moving said one part of each nozzle.

29. A nozzle assembly as set forth in claim 26 which further comprises a flexible structure mounting said balancing means in said means for moving said one part of each nozzle.

30. A nozzle assembly as a set forth in claim 29 wherein said flexible structure comprises a pair of arms capable of flexing relative to each other.

31. A thread treating nozzle comprising a plurality of parts which define between them a thread treating passage and which are movable relative to each other to open and close said passage to enable insertion of a thread;

means for applying a closing force to said parts to move said parts into a closed position; and at least one of said parts having a flexible mounting including a plurality of interconnected mounting elements for transmitting said closing force therethrough, said elements being movable relative to each other to enable relative adjustment of said pats into face to face sealing contact in said closed position despite initial localized contact between said parts.

32. A thread treating nozzle as set forth in claim 31 wherein said one part is movable with said means and the other of said parts is movable with said at least one part into a retracted position spaced from a thread path.

33. A thread treating apparatus comprising a treating nozzle for treating at least two threads each moving along a substantially predetermined thread path, said nozzle having a plurality of parts for defining a pair of thread treating passages, at least one of said parts being movable relative to one another part to open and close said passages for insertion of a thread into each said passage;

means for moving said nozzle between a retracted non-operative position clear of the thread paths and an extended operative position in which said nozzle encloses the thread paths; and thread guide means upstream and downstream of said nozzle considered relative to said thread paths, each said guide means being movable between an inoperative position to leave the thread free to move along said paths without disturbance and an operative position to engage and locate the threads to lie in said passages during closing of said nozzle, at least one of said guide means comprising an element provided with a substantially W-shaped edge to separate two threads into respective notches in said edge.

34. A thread treating apparatus comprising a treating nozzle for treating a thread moving along a substantially predetermined thread path, said nozzle having a plurality of parts for defining a thread treating passage, at least one of said parts being movable relative to another part to open and close said passage for insertion of a thread into said passage;

a movably mounted carrier for moving said nozzle between a retracted non-operative position clear of the thread path and an extended operative position in which said nozzle encloses the thread path; and thread guide means upstream and downstream of said nozzle considered relative to said thread path, each said guide means being movable between an inoperative position to leave the thread free to move along said path without disturbance and an operative position to engage and locate the thread to lie in said passage during closing of said nozzle, said upstream guide means being mounted on said carrier member.

35. In a texturizing station, the combination comprising at least a pair of elements defining a predetermined path for a thread passing therebetween;

a thread treating nozzle disposed between said elements for treating a thread moving along said predetermined path, said nozzle having a plurality of parts defining a thread treating passage, at least one of said parts being moveable relative to another part to open and close said passage for insertion of a thread into said passage; and means for moving said nozzle between a retracted non-operative position clear of said path and an extended operative position in which said nozzle encloses said thread path.

* * * * *

UNITED STATES PATENT AND TRADEMARK OFFICE

CERTIFICATE OF CORRECTION

PATENT NO. : 4,936,000

DATED : June 26, 1990

INVENTOR(S) : WERNER NABULON, et al

It is certified that error appears in the above-identified patent and that said Letters Patent is hereby corrected as shown below:

Column 2, line 16 change "can" to -can be-
Column 2, line 40 delete "engages a"
Column 2, line 43 change "engages" to -engages a-
Column 4, line 38 change "nozzles" to -nozzle-
Column 4, line 45 change "on" to -an-
Column 6, line 63 delete "22"
Column 9, line 33 change "as" to -an-
Column 11, line 49 change "is" to -as-
Column 12, line 46 change "nozzle" to -nozzles-
Column 13, line 13 change "or" to -for-

Signed and Sealed this

Fourth Day of February, 1992

*Attest:*

*Attesting Officer*

HARRY F. MANBECK, JR.

*Commissioner of Patents and Trademarks*